United States Patent [19]

Porter

[11] 4,338,975

[45] Jul. 13, 1982

[54] THREAD BRAKE FOR A TEXTILE MACHINE

[75] Inventor: Allan W. H. Porter, Lustmuehle, Switzerland

[73] Assignee: Adolph Saurer Ltd., Arbon, Switzerland

[21] Appl. No.: 111,645

[22] Filed: Jan. 14, 1980

[51] Int. Cl.[3] ..... D03D 47/34

[52] U.S. Cl. ..... 139/450; 139/452

[58] Field of Search ..... 139/429, 450, 452; 66/132; 112/DIG. 3

[56] References Cited

U.S. PATENT DOCUMENTS 3,915,199 10/1975 Kida ..... 139/452

4,192,357 3/1980 Tanaka et al. ..... 139/450

*Primary Examiner*—Henry Jaudon

*Attorney, Agent, or Firm*—Dority & Flint

[57] ABSTRACT

A thread brake for a textile machine, in particular a shuttleless loom, in which weft thread lengths are withdrawn from a store disposed outside the shed, wherein interruption of weft thread take-off is carried out by displacement of a take-off roller 6 rotating at constant peripheral speed from an operative position to an end position remote from the thread 1. The device comprises at least for one brake shoe a movable holder 21 which is movable between two end positions in the direction of the gap towards a holder 21' of the other brake shoe and at least indirectly connected to the loom shaft 8 in driving relationship. The displacement of one or each holder occurs against the force of a spring 23 or 23' which in the unloaded state corresponds to a distance between the two brake shoes corresponding to thread thickness. The thread brake according to the invention has, due to displacement of the holder(s) and hence the brake shoes, in operation an automatic cleaning action on account of which the brake shoes are automatically cleaned of deposited fluff.

6 Claims, 4 Drawing Figures

Fig.1
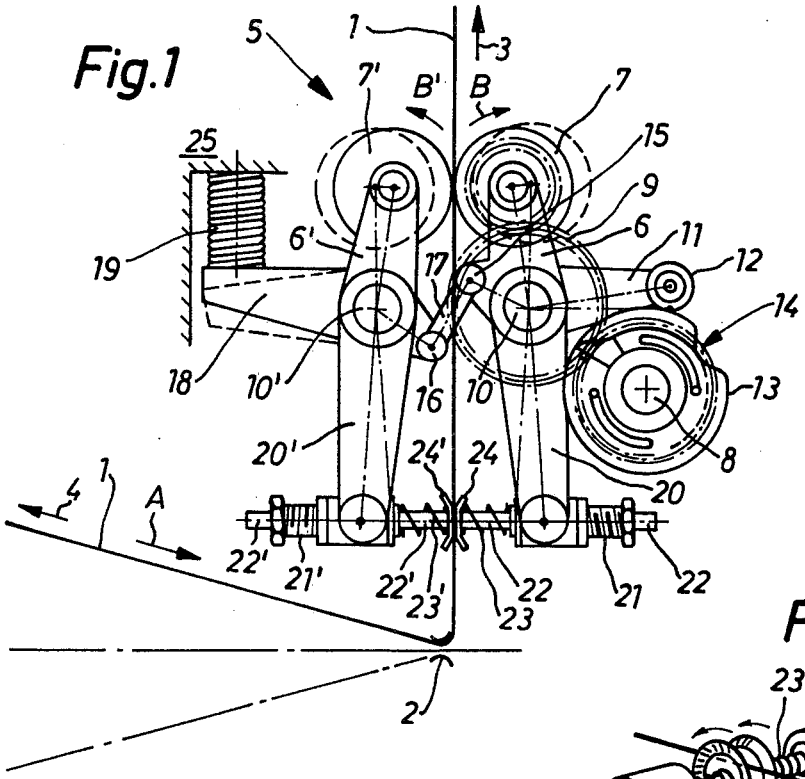
Fig.2
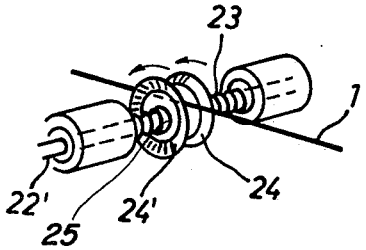
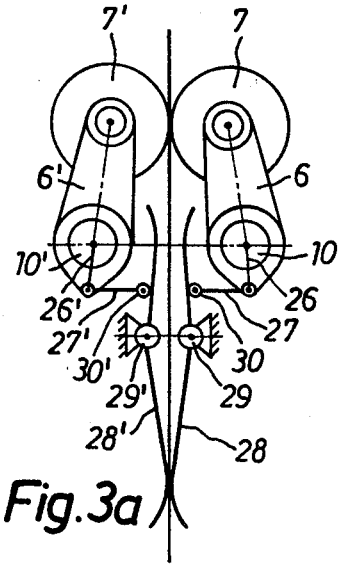
Fig.3a
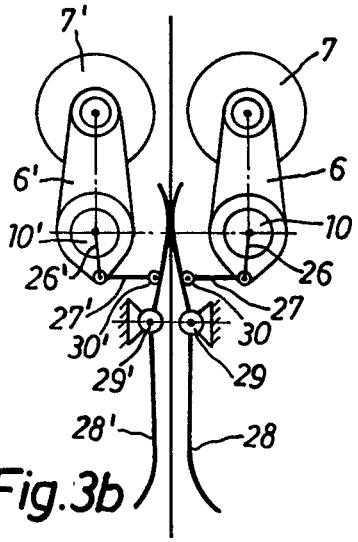
Fig.3b

THREAD BRAKE FOR A TEXTILE MACHINE

BACKGROUND OF THE INVENTION

The invention relates to a thread brake for a textile machine, in which a thread is guided between two opposed brake shoes operatively connected to holders.

Known thread brakes of the kind mentioned have the disadvantage that their brake force varies with time as a result of the fluff being deposited on the braking parts or that they must be cleaned often to eliminate this phenomenon.

A thread brake has already been used, in which the disk-shaped brake shoes are kept continuously in rotational movement positively by means of an electric motor provided especially therefor. The achievement therewith is that the points of contact of the thread with the brake shoes are constantly displaced. In the process, deposited fluff at any given time passes into the region of the thread moving away from the brake shoes, by which it is entrained, whereby automatic cleaning of the brake shoes takes place.

This solution however is very elaborate.

SUMMARY OF THE INVENTION

It is the object of the invention to provide a thread brake of the kind mentioned hereinbefore with simpler automatic cleaning of the brake shoes.

This is achieved according to the invention by the holder of at least one brake shoe being movable between two end positions in the direction of the gap towards the holder of the other brake shoe, and being at least indirectly connected in driving relationship to the machine.

In a preferred embodiment of the thread brake according to the invention, opposed brake shoes are constructed as disks and mounted rotatably on approximately coaxial journals. The bearing axes of the brake shoes are offset in relation to the path of the thread, and one or each brake shoe is connected to a movable holder and is axially displaceable against a spring which is fixed in one end position, and in this end position is at a distance from the other brake shoe corresponding to the thread thickness.

The achievement with this arrangement is that the brake shoes, in the periods of axial release, are entrained and set in rotation by the passing thread with which they are permanently in contact with a narrow-size gap, whereby the cleaning action described occurs automatically.

Another embodiment of the thread brake consists in that the brake shoes are constructed as spring-like lamellae arranged in the thread direction, whereof one or each is pivotably linked to a stationary support and at a distance therefrom to the movable holder, wherein the lamellae in one end position of the holder at one of their ends are in mutual pressure contact and at the other end are mutually spaced by a distance corresponding at least to thread thickness, and in the other end position of the holder are in the same mutual relationships, but with their ends interchanged. In this embodiment, shape and flexibility of the lamellae as well as pivotal coupling thereof may be selected so that transfer of contact with the thread from one lamella end to the other takes place at least without interrupting braking action.

The automatic cleaning action takes place herein by the fact that fluff being deposited is stripped on parting and can be entrained by the passing thread without obstruction due to narrowing.

The thread brake according to the invention is used advantageously in a device for intermittently taking off weft thread lengths from the store disposed outside the shed in shuttleless looms, in which interruption of take-off roller rotating at constant peripheral speed, from an operative position to an inoperative neutral position. Provision is made herein according to a further embodiment of the invention for the movable holder to be connected in moving relationship to the support of the withdrawing member.

This application is particularly advantageous in an above-mentioned device in which interruption of take-off is carried out during the weft insertion process and take-off of a portion of the weft thread lengths is effected in the last stage of this process by the weft inserter itself. When the take-off member is in the inoperative position, the holder is in the end position wherein spring pressure on the brake shoe is increased. The thread therein is subjected to a greater braking force which can be selected so that the weft thread inserted in the shed by the withdrawing weft inserter acquires the correct tension for beating up. Consequently an elaborate post-tensioning device, which is necessary with most looms without bobbins can be foregone.

Accordingly, it is an important object of the present invention to provide a thread brake which is automatically moved into a braking position responsive to disengagement of take-off rollers.

Another important object of the present invention is to provide a simple and reliable thread brake device that is synchronized with the operation of the textile machine and the yarn withdrawal from a store.

These and other objects and advantages of the invention will become apparent upon reference to the following specification, attendant claims and drawing.

BRIEF DESCRIPTION OF THE DRAWING

FIG. 1 shows a plan view of a first embodiment of a thread brake according to the invention, in use with a device for intermittently taking off weft thread lengths, FIG. 2 shows a detail from FIG. 1 in perspective view, FIG. *3a* shows a schematic plan view of a second embodiment of a thread brake according to the invention in the same use, in one end position of the holders of the braking parts, and FIG. *3b* shows the thread brake according to FIG. *3a* in the other end position.

DESCRIPTION OF A PREFERRED EMBODIMENT

In FIGS. 1 and 2, reference FIG. 1 denotes weft yarn which is withdrawn by a take-off device 5 from a store (not visible) situated in the direction of arrow 4, through an eye 2 in the direction of arrow A, and supplied to the loom (also not visible) situated in the direction of arrow 3.

The take-off device 5 comprises two rollers 7, 7' which are mounted on levers 6, 6' on both sides of the weft yarn and of which one is driven at constant speed in the direction of arrow B by the loom shaft 8 via intermediate gear 9. The levers 6, 6' are each mounted pviotably on a spindle 10, 10'.

A second lever 11 is non-rotatably connected to the lever 6 carrying the driven roller 7. The lever 11 carries at its end a cam roller 12 which rolls over the peripheral surface of a built-up cam plate 13 which is mounted on the loom shaft 8. The cam plate 13 comprises a recess 14 which is adjustable with respect to both its angular position and its width in the circumferential direction in relation to the loom shaft 8.

A linkage 17 which is coupled by means of joint 15 to lever 6 and by means of joint 16 to lever 6' connects the two levers 6, 6' in such a way that they perform pivot movements in opposite diections when cam roller 12 enters the recess 14. A compression spring 19 supported in the housing 25 of the device presses on a lever 18 which is non-rotatably connected to lever 6' and causes cam roller 12 to follow the outer shape of the cam plate.

Lever arms 20, 20' which are rigidly connected to lever arms 6, 6' are further mounted pivotably on the spindles 10, 10', pointing in a direction towards the approaching thread. Each lever arm 20, 20' comprises at its end a holder for a guide 21, 21' of which the length can be adjusted e.g., by means of thread and lock nut and in which a rod 22, 22' is mounted longitudinally displaceably, wherein the center line of the rod extends past the path of the weft thread. Each rod carries at its end facing towards the weft thread a disk-like brake shoe 24, 24', the shoes being mounted rotatably on approximately or precisely coaxial journals 25. On each brake shoe is supported one end of a helical compression spring 23, 23' of which the other end is rigidly supported on the guide 21, 21' of adjustable length.

The thread brake shown operates as follows:

If the cam roller 12 rolls over the unrecessed peripheral region of the cam plate 13, the rollers 7, 7' are in pressure contact with each other, whereby the roller 7 driven by the loom shaft 8 via the intermediate gear 9 entrains the counter-roller 7' and the thread lying between them. Weft thread is withdrawn from the rollers and supplied to the loom. Therewith the lever arms 20, 20' are in their outer end position in which the compression spring 23, 23' is just unloaded, so that it does not have an inhibiting effect on the disk-shaped brake shoes 24, 24' nor apply pressure to the thread. The brake shoes remain in pressure-less contact with the thread which has been withdrawn. Due to the slight friction which is nevertheless present with this kind of contact and the eccentric line of contact of the thread with the brake shoes, the latter go into slow rotational movement. If on further rotation of the loom shaft 8 roller 12 passes into the recess 14 in the cam plate 13, the lever arms 6, 6' tip over into their other extreme position, whereby the rollers 7, 7' lose contact with each other and with the thread 1. The latter is withdrawn e.g., by the weft inserter of the loom. The compression springs 23, 23' exert slight but sufficient pressure on the brake shoes 24, 24' to allow frictional force to increase by the desired amount which can be selected via the spring characteristic. In this state the brake shoes can rotate or stop, which plays no essential part and depends on the eccentricity of the line of contact of the thread with the brake shoes and on the inhibiting effect of the springs 23, 23'. Such rotation spares the thread 1, but is not compulsorily required.

In FIGS. 3*a* and 3*b*, which show the second embodiment of the brake likewise in use with a device for intermittently taking off weft thread lengths from the store. Only the take-off rollers 7, 7' and the lever arms 6, 6' supporting them together with their spindles 10, 10' are shown. Rigidly connected to each of these lever arms 6, 6' is a lever arm 26, 26' extending in a direction towards the approaching thread. Coupled to the end of each of these levers is a linkage 27, 27' of which the second end is coupled to a leaf spring-like lamella 28, 28' at 30, 30'. Each lamella 28, 28' is rotatably mounted approximately centrally in a fixed support 29, 29'. The supports of each lamella 28, 28' are arranged symmetrically with respect to the path of movement of the weft thread. The lamellae 28, 28' are shaped so as to press on each other with one of their ends in one end position of the take-off rollers according to FIG. 3*a*, with a force corresponding to the desired effect on the thread clamped in between. For instance, the force and hence the friction on the thread may be selected just infinitesimal. In the other end position of the take-off rollers according to FIG. 3*b*, the lamellae press on each other with their other end, wherein again the resulting force and hence the friction can be adapted to requirements. At each end position, the ends of the lamellae which are not in mutual contact are a distance apart from each other. The flexibility of the lamellae may also be selected so that the weft thread which has been withdrawn remains practically continuously in contact with the lamella, whether at one or the other of the two ends.

Mode of operation and actuation of the thread brake according to FIGS. 3*a*, 3*b* are moreover the same as in the embodiment according to FIG. 1. In particular, actuation can be derived, just as in FIG. 1, from the loom shaft not shown in FIGS. 3*a*, 3*b* and a cam drive, even though other types of actuation too are conceivable.

It is clear to any expert that the thread brake can also be used, instead of in shuttleless looms as described, in other textile machines in which a thread is withdrawn from a store and further processed.

What is claimed is:

1. A thread brake for a textile machine provided with a drive mechanism in which a thread is guided through a gap provided between two opposed brake shoes operatively connected to holders comprising:

means for moving at least one of said holders between two end positions in the direction of said gap towards said opposed shoe;

means indirectly connecting said means for moving at least one of said holders to said drive mechanism of said textile machine for synchronizing the movement of said one of said holders with the operation of said textile machine: and said opposed brake shoes being constructed as disks and mounted rotatably on approximately coaxial journals on opposed bearing axes which are offset with respect to the path of the thread, and said brake shoe connected to the movable holder is axially displaceable against a spring which is unloaded in one of said end positions and in this end position is at a distance from the other brake shoe generally corresponding to the thread thickness so that a slight constant friction exists between said thread and shoes;

whereby said shoes are rotated and cleaned of fluff and the like.

2. Thread brake according to claim 1, characterized in that the holder is one arm of a two-armed lever forming the take-off member support.

3. A thread brake for use with a shuttleless loom provided with a pair of take-off rollers, means driving at least one of said rollers, means selectively moving said rollers into and out of engagement with a thread for selectively taking off a length of weft thread from a store disposed outside the shed of said loom comprising:

a pair of movable holders each rotatably supporting a respective one of said rollers adjacent one end thereof;

a pair of disks;

each holder having means for rotatably journalling one of said disks adjacent another end thereof and in opposed relation;

resilient means biasing said disks into engagement with each other when said take-off rollers are out of engagement for braking said thread passing therebetween; and said resilient means applying a non-braking pressure to said thread when said rollers are moved into engagement with each other during take-off of said weft thread.

4. A thread brake for a textile machine provided with a drive mechanism in which a thread is guided through a gap provided between two opposed brake shoes operatively connected to holders comprising:

means for moving at least one of said holders between two end positions in the direction of said gap towards said opposed shoe;

means indirectly connecting said means for moving at least one of said holders to said drive mechanism of said textile machine for synchronizing the movement of said one of said holders with the operation of said textile machine; and said brake shoes are formed by spring-like lamellae having opposing ends extending in the direction of the thread path, where one or each is pivotably connected to a stationary support and at a distance therefrom to said movable holder, wherein the lamellae in one of said end positions of the holder are in mutual pressure contact at one of their ends and mutually spaced by a distance at least corresponding to thread thickness at the other end, and in the other of said end positions of the holder are in the same mutual relationships, but with their ends interchanged in contact.

5. Thread brake of a device for intermittently taking off weft thread length from a store disposed outside the shed in shuttleless looms according to claim 4 wherein interruption of weft thread take-off is carried out by displacing a take-off roller rotating at constant peripheral speed, from an operative position to an end position remote from the thread, character-connected in moving relationship to the take-off member support.

6. Thread brake according to claim 5, characterized in that the movable holder is articulately connected to the take-off member support.

* * * * *